US011432637B2

(12) United States Patent
Jeong et al.

(10) Patent No.: US 11,432,637 B2
(45) Date of Patent: Sep. 6, 2022

(54) COSMETIC CONTAINER

(71) Applicant: Amorepacific Corporation, Seoul (KR)

(72) Inventors: Jin Soo Jeong, Seoul (KR); Yoon Hee Lee, Seoul (KR); Min Ho Yu, Seoul (KR); Oh Soo Lee, Seoul (KR)

(73) Assignee: Amorepacific Corporation, Seoul (KR)

( * ) Notice: Subject to any disclaimer, the term of this patent is extended or adjusted under 35 U.S.C. 154(b) by 77 days.

(21) Appl. No.: 16/970,994

(22) PCT Filed: Feb. 12, 2019

(86) PCT No.: PCT/KR2019/001673
§ 371 (c)(1),
(2) Date: Aug. 19, 2020

(87) PCT Pub. No.: WO2019/164163
PCT Pub. Date: Aug. 29, 2019

(65) Prior Publication Data

US 2020/0397120 A1 Dec. 24, 2020

(30) Foreign Application Priority Data

Feb. 20, 2018 (KR) ..... 10-2018-0019713

(51) Int. Cl.
*A45D 40/22* (2006.01)
*A45D 33/14* (2006.01)
*A45D 34/00* (2006.01)

(52) U.S. Cl.
CPC ..... *A45D 40/22* (2013.01); *A45D 33/14* (2013.01); *A45D 34/00* (2013.01)

(58) Field of Classification Search
CPC ..... A45D 33/14; A45D 34/00; A45D 40/22; B65D 83/0027; B65D 83/00
See application file for complete search history.

(56) References Cited

U.S. PATENT DOCUMENTS 10,010,153 B2 * 7/2018 Kim ..... A45D 33/006
2002/0036214 A1 * 3/2002 Rousselet ..... B65D 83/0011 222/391
2015/0014365 A1 * 1/2015 Smith ..... B65D 83/0027 222/390

(Continued)

FOREIGN PATENT DOCUMENTS

FR 2792180 * 10/2000 ..... A45D 33/006
GB 2193944 * 2/1988 ..... A45D 40/0075
JP 2014-132966 A 7/2014

(Continued)

OTHER PUBLICATIONS

International search report for PCT/KR2019/001673 dated Jun. 7, 2019.

*Primary Examiner* — J C Jacyna
(74) *Attorney, Agent, or Firm* — Sughrue Mion, PLLC

(57) ABSTRACT

A cosmetic container is disclosed. The cosmetic container includes a container body which receives a cosmetic material and has a screw thread formed on the inner circumferential surface thereof; a moving frame having an edge on which a spiral protrusion coupled to the screw thread of the container body is formed; and a discharge part formed in the moving frame to discharge the cosmetic material.

5 Claims, 6 Drawing Sheets

(56) References Cited

U.S. PATENT DOCUMENTS

| | | | | |
|---|---|---|---|---|
| 2015/0353265 | A1* | 12/2015 | Jethwani | B65D 83/005<br>222/328 |
| 2020/0047978 | A1* | 2/2020 | Cedergren | A47G 19/18 |

FOREIGN PATENT DOCUMENTS

| | | | |
|---|---|---|---|
| JP | 10-2015-0000592 | | 1/2015 |
| JP | 20-2015-0000973 | | 3/2015 |
| KR | 10-2012-0074880 | A | 7/2012 |
| KR | 10-1446762 | B1 | 10/2014 |
| KR | 10-2016-0085124 | A | 7/2016 |
| KR | 20-2016-0002661 | U | 8/2016 |
| KR | 10-2016-0112060 | A | 9/2016 |

* cited by examiner

COSMETIC CONTAINER

CROSS-REFERENCE TO RELATED APPLICATIONS

This application is a National Stage of International Application No. PCT/KR2019/001673 filed Feb. 12, 2019, which claims priority under U. S. C. § 119(a) to Korean Patent Application No. 10-2018-0019713 filed Feb. 20, 2018.

TECHNICAL FIELD

One aspect of the present disclosure relates to a cosmetic container, more specifically, to a cosmetic container, in which cosmetic materials are discharged as a mesh net or a discharge plate formed on a container body is pressed, and at the same time, the mesh net or the discharge plate moves downward while rotating little by little so that it is possible to prevent the residue of the cosmetic materials from remaining in the cosmetic container and check the residue of the cosmetic materials.

BACKGROUND ART

In general, cosmetics are used mainly for women to make their appearance beautiful, and there are various kinds of cosmetics according to a function and a form.

The cosmetics are classified into base makeup cosmetics and point makeup cosmetics used for eyes, lips, or the like. The base makeup cosmetics include a foundation and a blusher, and the point makeup cosmetics include an eye shadow, an eye-liner, and a lipstick.

The foundation belonging to the base makeup cosmetics is classified into solid type foundation, liquid type foundation and gel type foundation according to a type of cosmetic contents. In case of the solid type foundation, although the solid-type foundation has a good cover effect, the makeup is agglomerated when the makeup is refreshed. In case of the liquid type foundation, although the liquid type foundation gives a good close contact feel, the persistency is weak.

Thus, recently, the gel type foundation, which provides a freshness with lightness and moisture, has been increasingly used.

For this reason, there is a need to develop a container for the gel type foundation. In general, the gel foundation is filled in a glass container or a tube container, and used in such a manner that users take or squeeze some of the gel foundation on their hands for use, and apply the gel foundation onto the skin using a puff or the hands.

However, according to the related art, in the case of the gel type foundation having a low viscosity, an aqueous material is separated from an oily material when stored for a long time, so it is necessary to shake the cosmetic container to evenly mix the aqueous material with the oily material when the foundation is used, thereby causing inconvenience.

In order to solve the above problem, the applicant has disclosed Korean Registered Patent No. 10-1257628, in which a gel type foundation is impregnated in an impregnating member accommodated in an inner container, and the inner container is accommodated in a compact container. Thus, even when a gel type foundation having a low viscosity is impregnated in an impregnating member, an aqueous material is not separated from an oily material due to the surface tension of the impregnating member, thereby making it possible to stably use the gel type foundation.

However, according to the above related art, it is necessary for a user to put the gel type foundation of the impregnating member on a puff in use. Thus, when the gel type foundation on the top of the impregnating member has been completely used, the gel type foundation remains only on the bottom of the impregnating member by gravity, so the gel type foundation is rarely put on the puff even when the user presses the impregnating member using the puff.

In order to solve the above problem, the applicant has disclosed Korea Utility Model No. 20-0475971, in which a push plate is coupled to a lower portion of an inner container accommodating an impregnating member impregnated with the cosmetic materials, such that the cosmetic materials remaining on the bottom of the inner container can be moved up as the push plate coupled to the lower portion of the inner container is pressed, thereby allowing the user to use all of the cosmetic materials.

However, according to the above related art, the cosmetic materials moved up from the bottom of the impregnating member by pressing the push plate are moved back to the bottom of the impregnating member by gravity over time. Thus, the user has to periodically press the push plate to move up the cosmetic materials from the bottom of the impregnating member, causing inconvenience of use.

In addition, according to the above related art, since the cosmetic materials are impregnated in the impregnating member, the user may not accurately know the amount of the remaining cosmetic materials.

RELATED ART DOCUMENTS

Patent Documents (Patent Document 0001) Korean Registered Patent No. 10-1257628 (issued on Apr. 29, 2013), "Cosmetics including urethane foam impregnated with cosmetic composition".

(Patent Document 0002) Korean Registered Utility Model No. 20-0475971 (issued on Jan. 16, 2015), "Compact container capable of easily preventing residue of gel contents".

DISCLOSURE

Technical Problem

The present disclosure has been suggested to solve the above problems occurring in the related art, and an object of one aspect of the present disclosure to provide a cosmetic container including a container body which receives a cosmetic material and has a screw thread formed on an inner circumferential surface thereof and a moving frame coupled to the screw thread of the container body, in which the moving frame has an edge on which a spiral protrusion is formed to allow the moving frame to move downward while rotating along the screw thread, a mesh net or a discharge plate is formed on an upper portion of the moving frame, a user can discharge the cosmetic material by pressing the mesh net or the discharge plate, at the same time, the spiral protrusion of the moving frame moves downward while rotating little by little along the screw thread of the container body by the pressing force, all the cosmetic material contained in the container body can be used so that the residue of the cosmetic material does not remain, and the moving frame moves downward while rotating in proportion to the amount of the cosmetic material used by the user so that the user can visually check the remaining amount of the cosmetic material.

In addition, another object of one aspect of the present disclosure is to provide a cosmetic container, capable of preventing a moving frame from being separated from a container body by forming a fixing protrusion at an end of a screw thread inside the container body.

Technical Solution

One aspect of the disclosure provides a cosmetic container including: a container body which receives a cosmetic material and has a screw thread formed on the inner circumferential surface thereof; a moving frame having an edge on which a spiral protrusion coupled to the screw thread of the container body is formed; and a discharge part formed in the moving frame to discharge the cosmetic material.

In addition, the cosmetic material may be discharged as the discharge part is pressed and the moving frame may be rotated while gradually moving downward of the container body by pressing force In addition, a container lid for opening and closing the container body may be formed at one side of the container body.

In addition, a fixing protrusion may be formed at a tip of the screw thread of the container body, and the fixing protrusion may prevent the moving frame from being separated from the container body.

In addition, the discharge part may include a mesh net.

In addition, the mesh net may be bonded to the moving frame.

In addition, the discharge part may include a discharge plate having a discharge hole.

In addition, the discharge plate may be bonded to the moving frame.

In addition, the discharge plate may be formed integrally with the moving frame.

Advantageous Effects

According to one aspect of the present disclosure, the cosmetic container includes the container body which receives the cosmetic material and has the screw thread formed on an inner circumferential surface thereof and the moving frame coupled to the screw thread of the container body, in which the moving frame has an edge on which a spiral protrusion is formed to allow the moving frame to move downward while rotating along the screw thread, a mesh net or a discharge plate is formed on an upper portion of the moving frame, a user can discharge the cosmetic material by pressing the mesh net or the discharge plate, at the same time, the spiral protrusion of the moving frame moves downward while rotating little by little along the screw thread of the container body by the pressing force, all the cosmetic material contained in the container body can be used so that the residue of the cosmetic material does not remain, and the moving frame can move downward while rotating in proportion to the amount of the cosmetic material used by the user so that the user can visually check the remaining amount of the cosmetic material.

In addition, the moving frame can be prevented from being separated from the container body by forming the fixing protrusion at an end of the screw thread inside the container body.

BEST MODE

Hereinafter, embodiments of the cosmetic container according to the present disclosure will be described with reference to the accompanying drawings.

Figure 1:
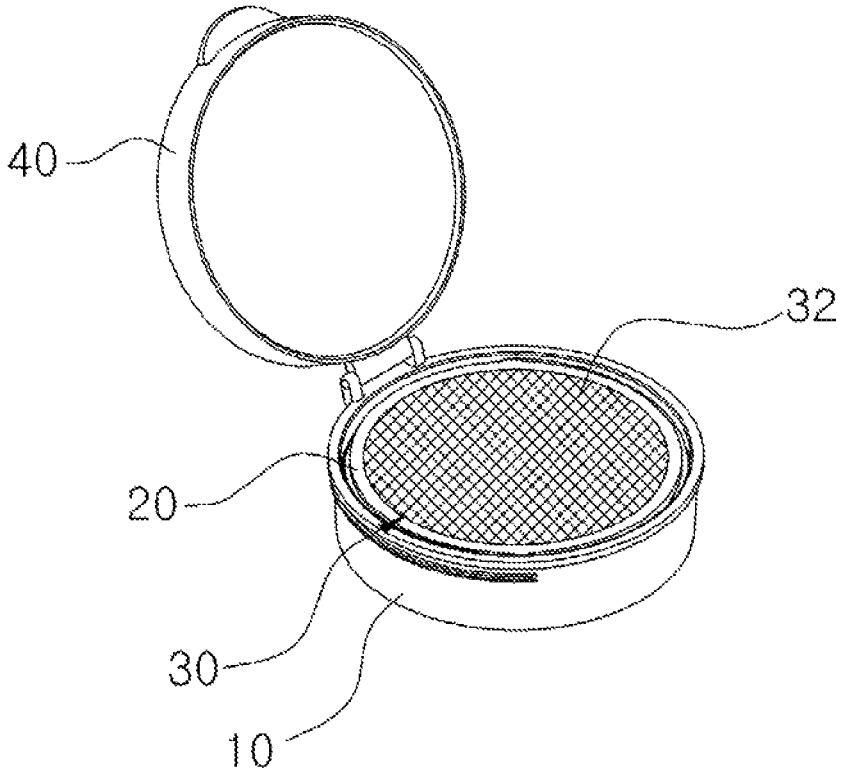
FIG. 1 is a perspective view of a cosmetic container according to a first embodiment of the present disclosure.
Figure 2:
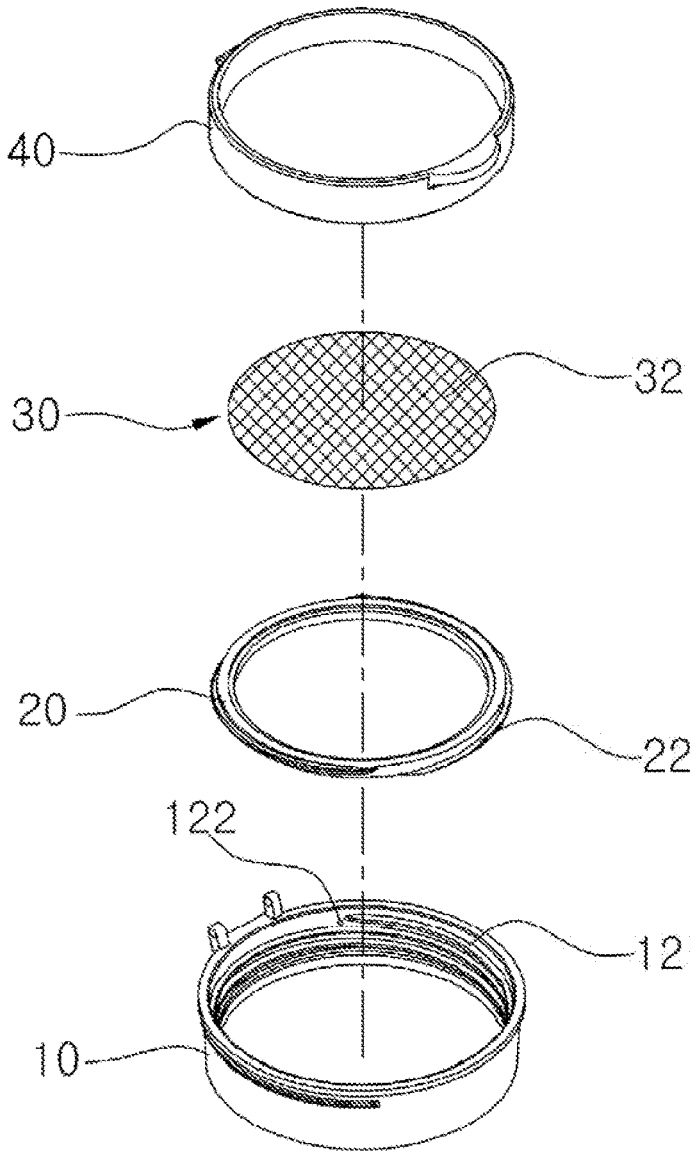
FIG. 2 is an exploded perspective view of a cosmetic container according to a first embodiment of the present disclosure.
Figure 3:
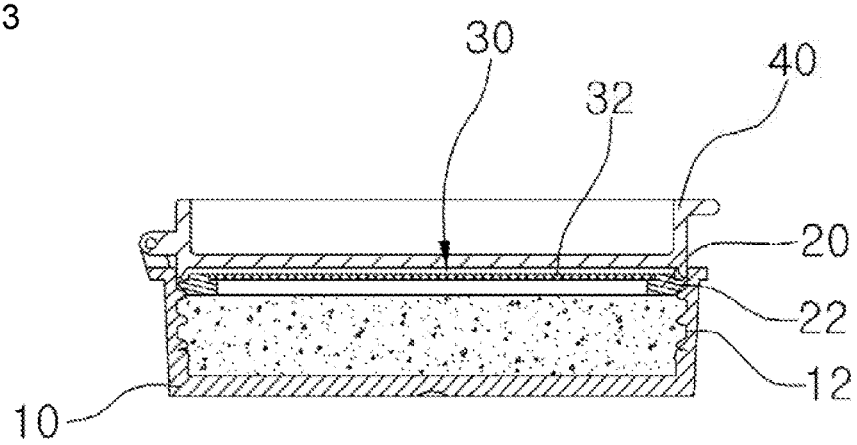
FIG. 3 is a sectional view of a cosmetic container according to a first embodiment of the present disclosure.
Figure 4:
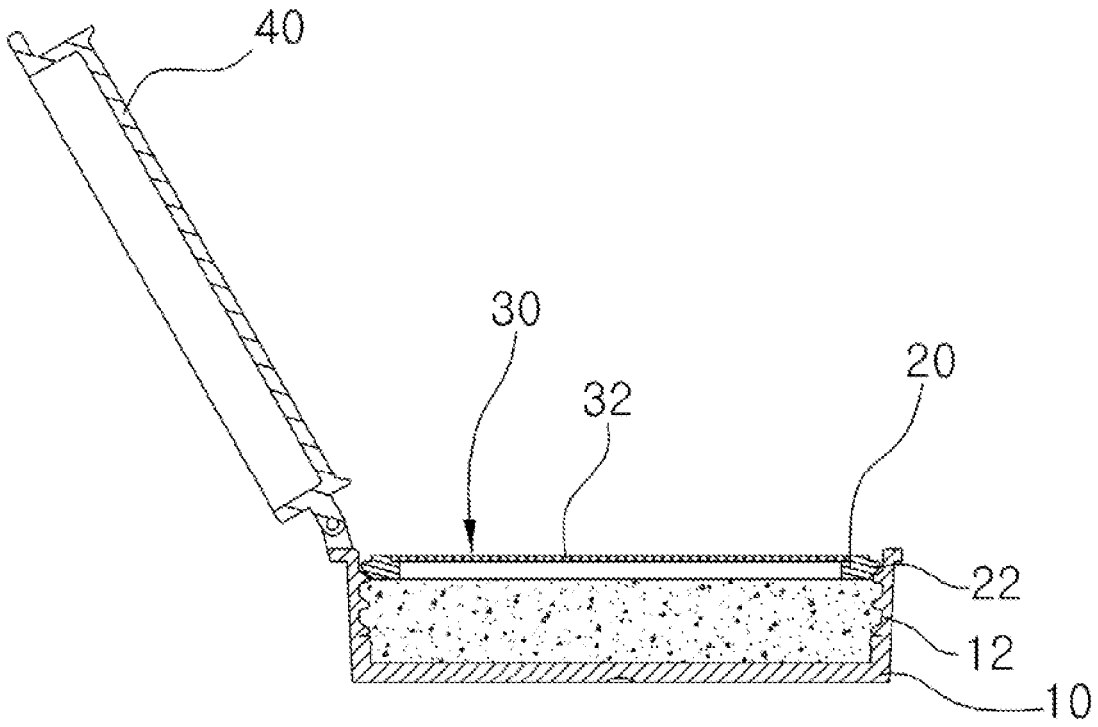
FIGS. 4 to 6 are views showing a state of using a cosmetic container by opening a container lid of the cosmetic container according to a first embodiment of the present disclosure.
Figure 5:
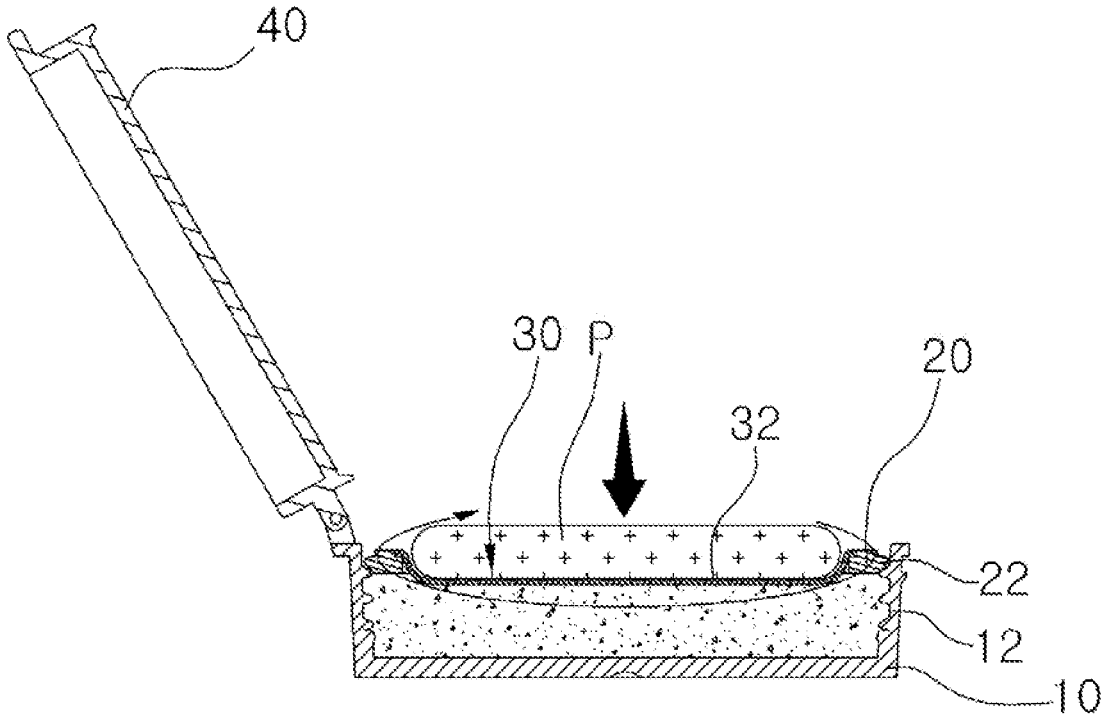
Figure 6:
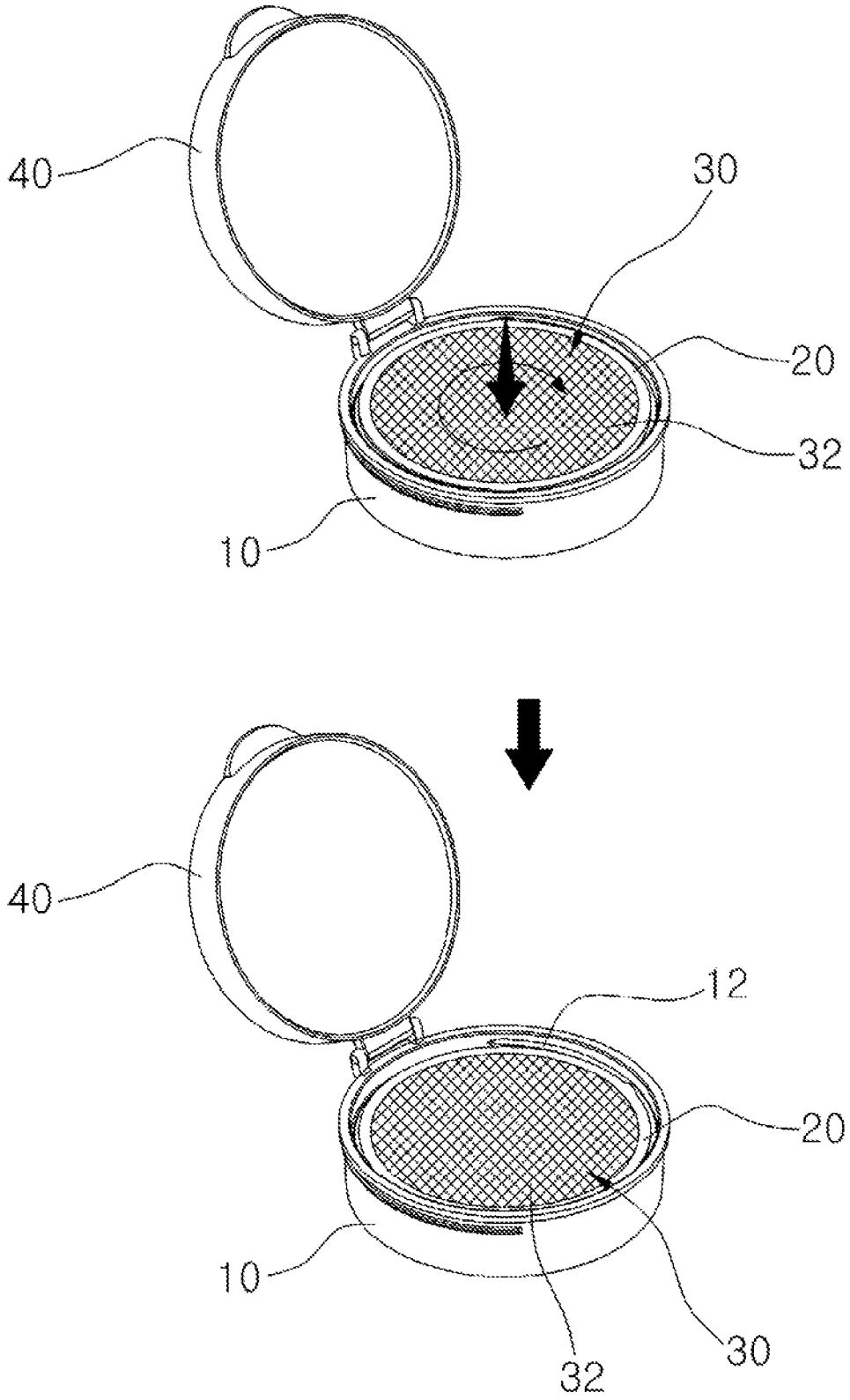
Figure 7:
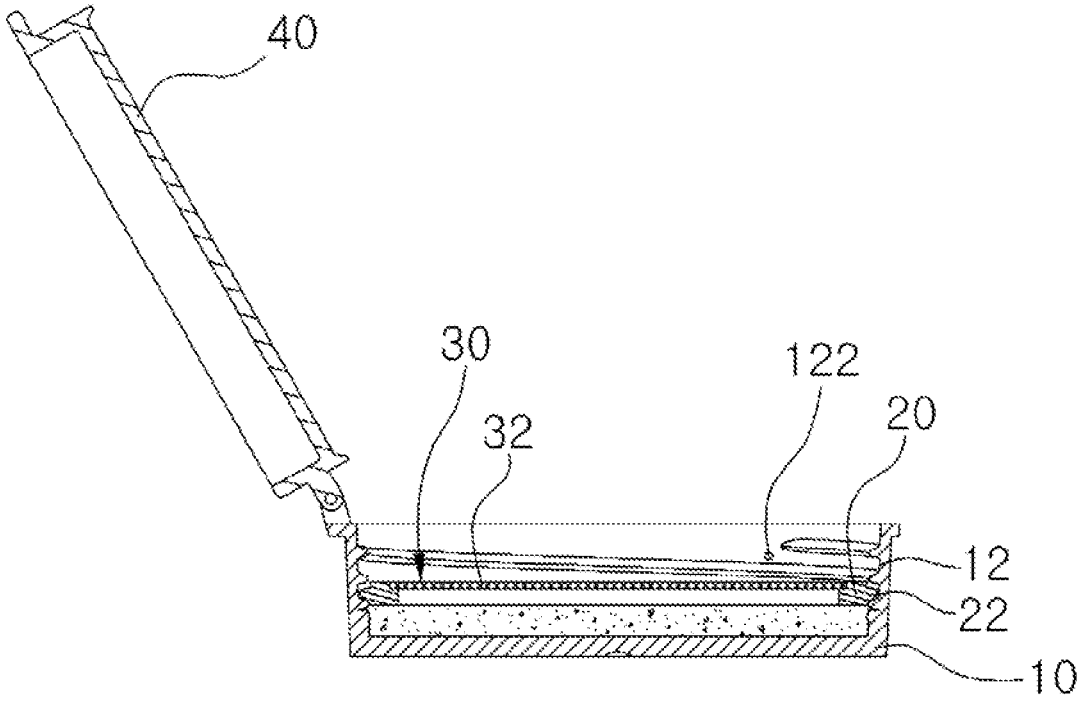
FIG. 7 is a sectional view of a moving frame of a cosmetic container according to a first embodiment of the present disclosure.
Figure 8:
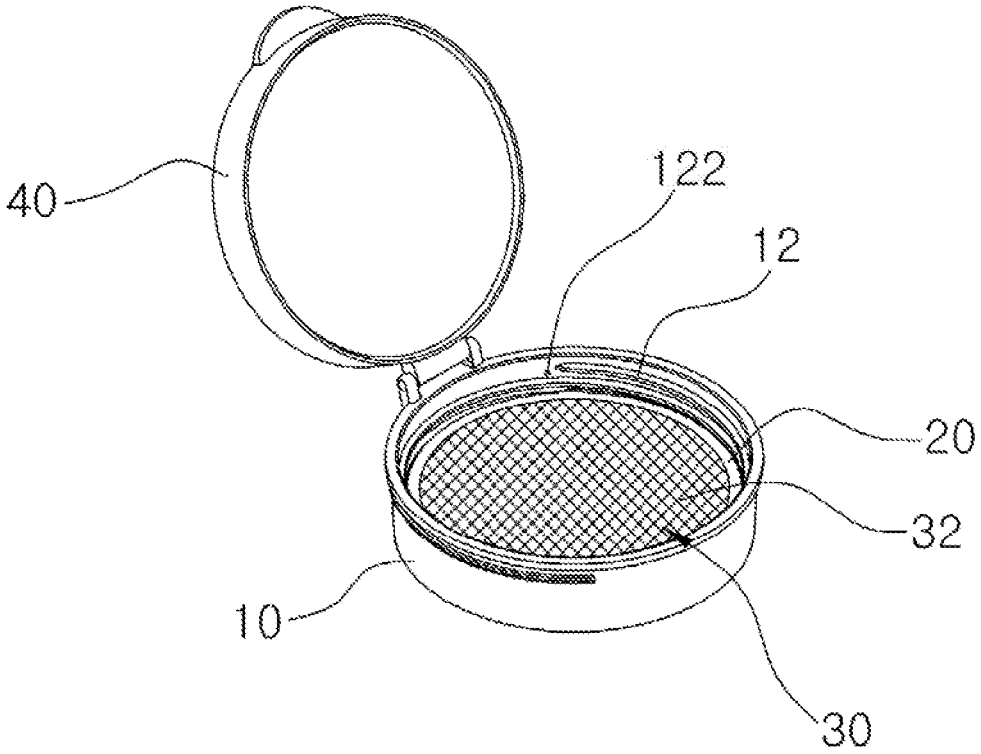
FIG. 8 is a perspective view of a moving frame of a cosmetic container when the moving frame is moved according to a first embodiment of the present disclosure.

FIG. 1 is a perspective view of a cosmetic container according to a first embodiment of the present disclosure, FIG. 2 is an exploded perspective view of the cosmetic container according to the first embodiment of the present disclosure, FIG. 3 is a sectional view of the cosmetic container according to the first embodiment of the present disclosure, FIGS. 4 to 6 are views showing a state of using the cosmetic container by opening a container lid of the cosmetic container according to the first embodiment of the present disclosure, FIG. 7 is a sectional view of a moving frame of the cosmetic container according to the first embodiment of the present disclosure, and FIG. 8 is a perspective view of the moving frame of a cosmetic container when the moving frame is moved according to the first embodiment of the present disclosure.

One aspect of the disclosure provides a cosmetic container including a container body 10 which receives a cosmetic material and has a screw thread 12 formed on the inner circumferential surface thereof, a moving frame 20 having an edge on which a spiral protrusion 22 coupled to the screw thread 12 of the container body 10 is formed, and a discharge part 30 formed in the moving frame 20 to discharge the cosmetic material.

The cosmetic material may be contained in the container body 10, and the screw thread 12 may be formed on the inner circumferential surface of the container body 10.

As shown in FIGS. 7 and 8, a fixing protrusion 122 may be formed at a tip of the screw thread 12, and the fixing protrusion 122 may prevent the moving frame 20 coupled to the screw thread 12 from being separated from the container body 10.

The spiral protrusion 22 may be formed on an edge of the moving frame 20.

The spiral protrusion 22 of the moving frame 20 may be coupled to the screw thread 12 of the container body 10 so that the moving frame 20 coupled to the discharge part 30 may rotate while moving downward along the screw thread 12.

That is, as shown in FIGS. 5 and 6, when the cosmetic material is discharged by pressing the discharge part 30 using a puff P, the moving frame 20 is gradually rotated while moving downward by the pressing of the puff P, so that the moving frame 20 moves downward in proportion to an amount of used cosmetic materials.

The discharge part 30 may be a portion for discharging the cosmetic material. As shown in FIG. 3, the discharge part 30 may include a mesh net 32 having elasticity.

The mesh net 32 may be bonded to the moving frame 20 by ultrasonic bonding or adhesive bonding.

Figure 9:
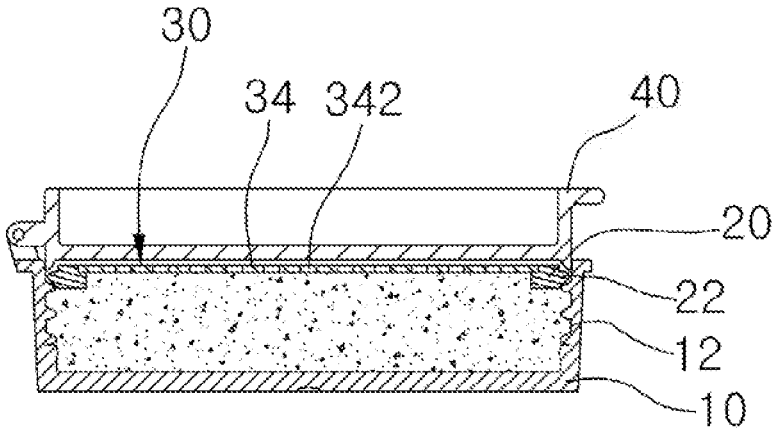
FIG. 9 is a sectional view of a cosmetic container according to a second embodiment of the present disclosure.
Figure 10:
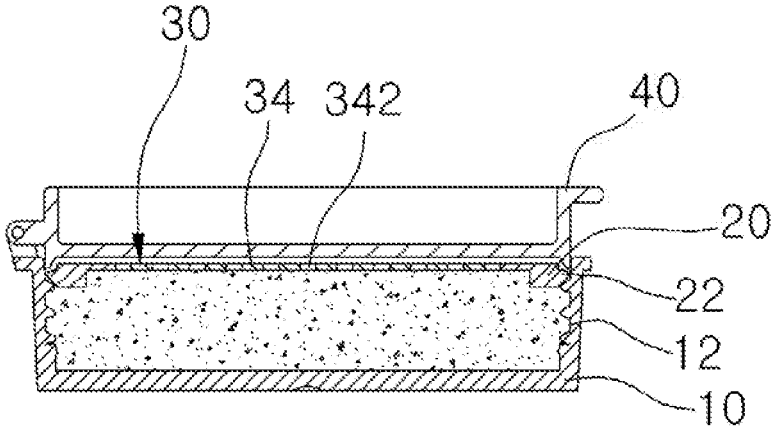
FIG. 10 is a sectional view of a cosmetic container according to a third embodiment of the present disclosure.

FIG. 9 is a sectional view of a cosmetic container according to a second embodiment of the present disclosure, and FIG. 10 is a sectional view of a cosmetic container according to a third embodiment of the present disclosure.

In addition, as shown in FIG. 9, the discharge part may include a discharge plate 34. The discharge plate 34 may have a discharge hole 342 so that the cosmetic material contained in the container body 10 may be discharged through the discharge hole 342.

The discharge plate 34 may be bonded to the moving frame 20 by ultrasonic bonding or adhesive bonding, or may be integrally formed with the moving frame 20 as shown in FIG. 10.

A container lid 40 for opening and closing the container body 10 may be formed at one side of the container body 10. The container lid 40 may prevent the cosmetic material contained in the container body 10 from being exposed to the outside when the cosmetic material is not used.

Hereinafter, a method of assembling and using the cosmetic container according to the embodiment of the present disclosure will be described in detail.

In order to assemble the cosmetic container of the present disclosure, the container lid 40 is coupled to one side of the container body 10, and the container body 10 is filled with the cosmetic material.

Thereafter, the screw thread 12 formed on the inner circumference of the container body 10 is coupled to the spiral protrusion 22 of the moving frame 20 having the discharge part 30, and then the container body 10 is covered with the container lid 40, thereby completing the assembling work.

In this case, the discharge part 30 is formed as the mesh net 32 or the discharge plate 34 having the discharge hole 342.

In order to use the cosmetic material of the cosmetic container assembled by the above method, the container lid 40 is opened as shown in FIG. 4.

Then, as shown in FIG. 5, the discharge part 30 is pressed using the puff P.

As the discharge part 30 is pressed by the puff P, the cosmetic material is discharged through the discharge part 30, and at the same time, the spiral protrusion 22 of the moving frame 20 is rotatably moved downward along the screw thread 12 of the container body 10 by the pressing force as shown in FIG. 6.

According to the cosmetic container of the present disclosure, the cosmetic materials contained in the container body 10 can be completely used, so that the residue of the cosmetic materials may not remain in the container body, and the moving frame 20 can rotatably move downward in proportion to an amount of used cosmetic materials, so that the user can visually check the remaining amount of the cosmetic materials as shown in FIGS. 7 and 8.

The above description is merely an embodiment for implementing the cosmetic container, and the present disclosure is not limited to the above embodiment. As defined in the appended claims, various changes may be made by those skilled in the art to which the invention pertains without departing from the spirit of the present disclosure and those changes should be considered to fall within the scope of the invention.

DESCRIPTION OF REFERENCE NUMERALS

10: container body 20: moving frame
30: discharge part 40: container lid

The invention claimed is:

1. A cosmetic container comprising:

a container body which receives a cosmetic material and has a screw thread formed on an inner circumferential surface thereof;

a moving frame having an edge on which a spiral protrusion coupled to the screw thread of the container body is formed so that the moving frame rotatably moves downward along the screw thread; and a discharge part formed in the moving frame to discharge the cosmetic material, wherein the discharge part is formed of a mesh net having elasticity, and wherein the cosmetic material is discharged through the discharge part as the discharge part is pressed and the moving frame is rotated in proportion to an amount of used cosmetic materials while gradually moving downward of the container body by pressing force applied to the discharge part.

2. The cosmetic container of claim 1, wherein the cosmetic material is discharged as the discharge part is pressed and the moving frame is rotated while gradually moving downward of the container body by pressing force.

3. The cosmetic container of claim 1, wherein a container lid for opening and closing the container body is formed at one side of the container body.

4. The cosmetic container of claim 1, wherein a fixing protrusion is formed at a tip of the screw thread of the container body, and the fixing protrusion prevents the moving frame from being separated from the container body.

5. The cosmetic container of claim 1, wherein the mesh net is bonded to the moving frame.

* * * * *